United States Patent [19]

Cruise

[11] Patent Number: 5,031,599

[45] Date of Patent: Jul. 16, 1991

[54] ATTACHMENT OF BOWSTRING AND CABLES TO COMPOUND BOW

[76] Inventor: Billy J. Cruise, 28494 Siesta La., Eugene, Oreg. 97402

[21] Appl. No.: 192,779

[22] Filed: May 11, 1988

[51] Int. Cl.[5] ..... F41B 5/00

[52] U.S. Cl. ..... 124/23.1; 124/900

[58] Field of Search ..... 124/1, 16, 23 R, 24 R, 124/25, 27, 80, DIG. 1

[56] References Cited

U.S. PATENT DOCUMENTS

| | | | |
|---|---|---|---|
| 3,486,495 | 12/1969 | Allen | 124/24 |
| 3,841,295 | 10/1974 | Hunter | 124/24 |
| 3,851,638 | 12/1974 | Alexander | 124/24 |
| 3,958,551 | 5/1976 | Ketchum | 124/24 R |
| 3,967,609 | 7/1976 | Frylenlund | 124/24 |
| 4,201,177 | 5/1980 | Holman et al. | 124/23 R |
| 4,241,715 | 12/1980 | Jennings | 124/24 R |
| 4,368,718 | 1/1983 | Simonds et al. | 124/DIG. 1 |
| 4,401,097 | 8/1983 | Simonds et al. | 124/23 |
| 4,519,374 | 5/1985 | Miller | 124/DIG. 1 |
| 4,702,067 | 10/1987 | Izuta | 124/90 |

*Primary Examiner*—Randolph A. Reese
*Assistant Examiner*—Carol I. Bordas

[57] ABSTRACT

A compound bow including a respective eccentric device pivotably mounted on each of two oppositely directed limbs, and a bowstring which includes a pair of opposite looped end portions, each looped end portion extending around a post provided on a respective one of the eccentric devices. A leader portion of the bowstring extends around a portion of the periphery of the eccentric device and thence towards the opposite eccentric device. Each of a pair of cables includes a terminal portion fastened to a respective eccentric device, a portion of the cable extending around a portion of the periphery of the respective eccentric device and thence toward the opposite end of the bow. The bowstring and the cables may all be of a non-metallic flexible cord of suitable strength, with a looped terminal portion attaching respective ends of each cable and the bowstring to the eccentric devices.

9 Claims, 3 Drawing Sheets

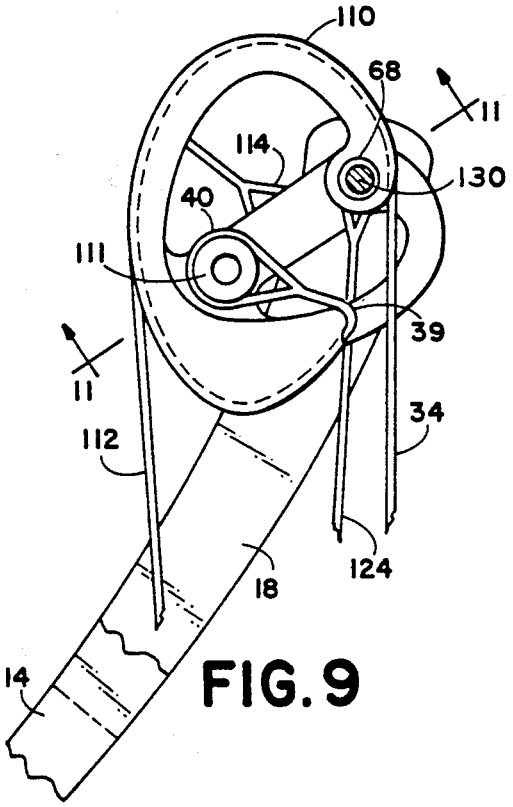
FIG. 9
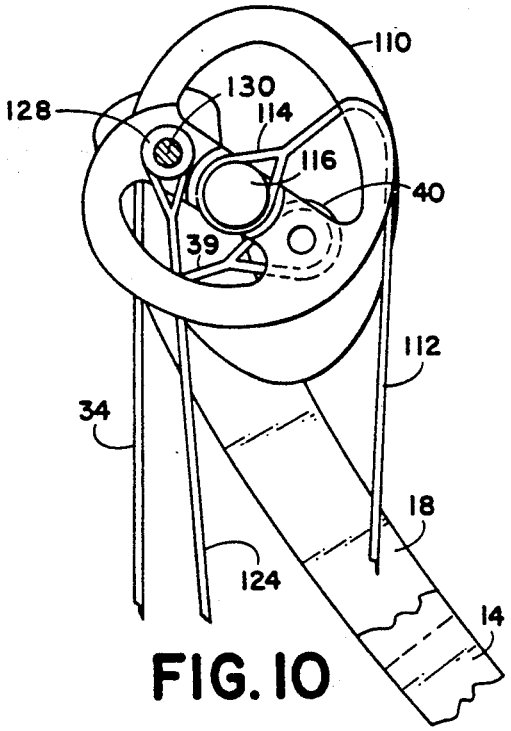
FIG. 10
FIG. 12
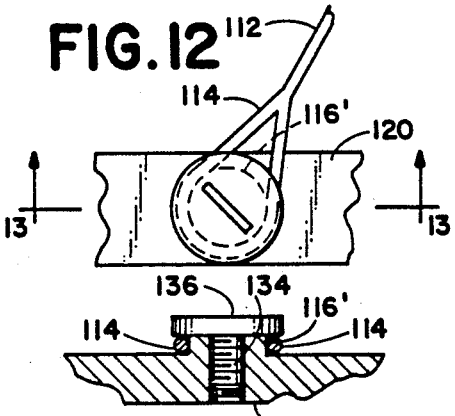
FIG. 13
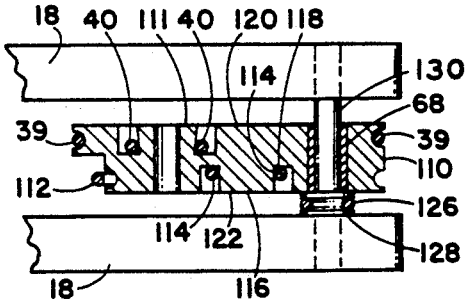
FIG. 11

ATTACHMENT OF BOWSTRING AND CABLES TO COMPOUND BOW

BACKGROUND OF THE INVENTION

The present invention relates to archery bows, and particularly to improvements of the attachment of bow strings and cables to the force-multiplying eccentric cams or wheels of a compound bow.

Compound bows are described in Allen U.S. Pat. No 3,486,495. In a compound bow the ends of opposite ends of limbs of the bow are drawn together partly by the action of flexible tension-bearing members, usually steel cables, being wound on eccentric cams or wheels, etc., hereinafter generally called eccentric devices, which are rotated by the action of drawing the bow. As the bow is drawn, extension portions of the bowstring are unwound from around a portion of each of the eccentric devices, rotating them about respective axes of rotation which are located at the tips of the limbs of the bow, oriented perpendicular to the plane of the bow string and bow. This causes the cables to be wound onto the eccentric devices. Since the cables and bowstring both act to pull the tips of the opposite limbs toward each other, both the cables and the bowstring need to be securely attached to the eccentric devices. Previously, the cables have extended around each eccentric device and a "pigtail" end of each cable has extended from the eccentric device, with a fitting being attached to the end of the pigtail to receive the looped end of a bowstring, usually made of a more elastic fiber. The bowstring is fastened to the end of the cable extending from the eccentric device at each end of the bow and is thus relatively easily exchangeable when it has become worn. However, there is some hazard associated with this manner of attachment of the bowstring, since the portion of the cable between the eccentric device and the bowstring is the portion of the cable which receives the highest stresses and the greatest amount of flexure and twisting. As a result, this portion of the cable is most frequently subject to failure during use of a compound bow. Particularly when a compound bow of high power is being used to cast arrows of relatively light weight, the sudden stresses occurring as the bowstring reaches its final position and the arrow leaves the bow may result in dangerous breakage, with the teardrop-shaped bowstring attachment member being carried away by the bowstring as it elastically contracts, making the attachment member and any attached piece of cable into a dangerous flail or projectile.

Another disadvantage of the use of such a steel cable pigtail is that since such a pigtail of steel cable is somewhat heavier than other materials which could be used, the mass of the length of the steel cable pigtail, and that of the bow string attachment teardrops or other similar devices, are greater contributions to the total inertia of the bow than is desired. Bow performance, then, could be improved by the ability to replace the steel cable pigtails and the swaged-on bowstring attachments, if a practical method of attachment of the bowstring directly to the eccentric device is made available.

A problem in the past, however, has been that it has not been known how to attach an end of a cable or bowstring securely enough to an eccentric device to be safe in use, where the possibility of loosening creates a serious risk of injury to the user of the compound bow, because of the greater tension forces involved, and because of the greater amounts of shock encountered, particularly by the bowstring.

What is desired, then, is an improved, safer, compound bow in which the cables and the bowstring are attached securely to the eccentric cam or wheels, without the need for a pigtail and its included hook or the like, and in which the cables and bowstring are adjustable and replaceable with reasonable ease.

SUMMARY OF THE INVENTION

The present invention overcomes the aforementioned shortcomings of previous compound bows by providing a compound bow having eccentric devices to which terminal portions the bowstring and cables are attached directly, so that there is no short wire cable subject to flexure and twisting near the eccentric device or a fastening device for attaching a looped end of a bowstring to such a wire cable. In accordance with the present invention a bowstring is preferably made of material more flexible than a metallic wire cable, and preferably somewhat more elastic than a wire cable but less elastic than previously used bow strings, and each end of such a bowstring is attached directly to the eccentric device. Cables may also be of similar materials also attached directly to the eccentric devices.

The present invention provides for attachment of terminal portions of a bow string and a cable of a compound bow directly to eccentric devices which may be of circular, nearly circular, or other so-called cam shapes, and which may include separate peripheral grooves in side-by-side planes. In a preferred embodiment of the invention open areas are provided within the area surrounded by a rim of the eccentric devices, and attachment posts for the cables and bowstring extend axially, that is from side to side of the eccentric devices, parallel with the axis of rotation, a portion of each post being in the plane of a peripheral groove. A respective looped end portion of the bow string or cable may be placed about the post, which has a tapered shape or a radially projecting head to retain the loop when tension is applied to the bow string or cable in a direction parallel to the plane of the peripheral groove.

When a cable made of wire is used, a removable cap, held in place by a fastener such as a screw, may be provided in accordance with one embodiment of the invention. Alternatively, a metal cable may be attached to the eccentric device by being wrapped partway around a post and extending thence into a through-hole defined in a portion of the eccentric device, with a setscrew in a threaded bore intersecting the through-hole being used to clamp the cable. Preferably, the post about which the cable is bent is drilled and tapped axially to receive the setscrew, with the through-hole extending diametrically through the base of the post.

A similar post for holding the bowstring in place may have its base on the side of the eccentric device whose periphery defines a groove to receive the cable, with the post extending laterally into an open area surrounded by a rim portion of the eccentric device which defines a peripheral groove for receiving the bowstring. The post for receiving the cable preferably extends oppositely for use with a cable including a looped end portion, although it may extend toward the same side of the eccentric device as the post for receiving the bowstring, if a steel wire cable is to be wrapped around the post and thence extend into a through-hole to be secured by a setscrew. Preferably, an enlarged head or a tapered shape is provided for a post about which a loop is to be placed, so that the tapered shape tends to hold the loop in place when the cable or bowstring is in tension.

It is therefore a principal object of the present invention to provide an improved eccentric device for a compound bow.

Another important object of the present invention is to provide an improved, safer manner of attachment of cables and bowstring to the eccentric devices of a compound bow.

A further object of the present invention is to provide a combination of bowstring, cable, and eccentric device for a compound bow, which overcomes the previous safety problems resulting from failure of metal cable portions as a result of metal fatigue or the like.

It is an important feature of the present invention that it provides an eccentric device including a post as a point of direct attachment to the eccentric device for a looped terminal portion of a bowstring, yet without requiring any additional space for such attachment beyond the space for the shape and size of the eccentric device required to provide for the power and draw let-off desired in the bow.

Another important feature of the present invention is the provision of an eccentric device including an axially extending post including a through-hole and intersecting setscrew, for securely fastening a metal cable to the eccentric device, within the space defined by the shape and size required of the eccentric device for provision of the desired performance characteristics of the bow.

It is an important advantage of the present invention that it provides for attachment of looped end portions of a bowstring directly to an eccentric device of a compound bow, so that it is unnecessary to include a metal cable pigtail portion extending away from the eccentric devices as a place of attachment for the ends of a bowstring, and dangerous failure of such a pigtail cable segment is thus avoided.

Another advantage of the present invention is that it provides for improved performance of a compound bow, since it eliminates a certain amount of mass near the tips of the bow limbs, thus reducing the amount of inertia of the bow itself, so that more of the force of the bow limbs is directed through the bostring to cast an arrow.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 9 is a left side elevational view similar to that of FIG. 2, showing a portion of a compound bow having an eccentric device which is a further embodiment of the present invention.

FIG. 10 is a right side partially cutaway right side elevational view similar to that of FIG. 3, showing the eccentric device shown in FIG. 9.

FIG. 11 is a sectional view, taken along line 11—11 of FIG. 9, showing the eccentric device shown in FIGS. 9 and 10, together with a portion of the bow limb on which the eccentric device is mounted.

FIG. 12 is a side elevational view of a detail of an eccentric device embodying the present invention, in which a wide head of a fastener is utilized to secure a loop to the eccentric device.

FIG. 13 is a sectional view, taken along line 13—13, of the post and fastener combination shown in FIG. 12.

DETAILED DESCRIPTION OF THE INVENTION

Figure 1:
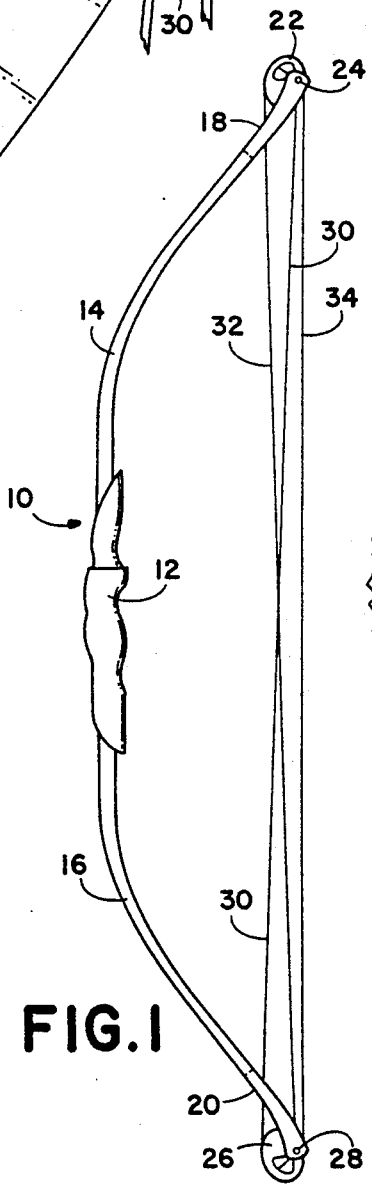
FIG. 1 is a side elevational view of a compound bow equipped with exemplary eccentric devices according to the present invention.

Referring now to the drawings which form a part of this disclosure, in FIG. 1 a compound bow 10 includes a riser 12, to which are attached an upper limb 14 and a lower limb 16. The upper limb 14 defines a forked tip portion 18, while the lower limb 16 includes a forked tip portion 20. An eccentric device 22 having a non-circular "cam" shape is located between the two legs of the forked tip portion 18 and is pivotable about an axis of rotation 23 extending transversely of the bow 10, defined by a pivot pin 24 extending transversely of the bow through the forked tip portion 18 and also through the eccentric device 22. An eccentric device 26 which is a mirror image of the eccentric device 22 is similarly mounted on a pivot pin 28 extending transversely through the forked tip portion 20 of the lower limb 16.

A pair of cables 30, 32 each extend from a point of attachment to one of the limbs 14 and 16 to the respective eccentric device 22 or 26 mounted on the opposite limb, and the opposite ends of a bowstring 34 are each fastened to a respective one of the eccentric devices 22 and 26. Preferably, the bowstring 34 is made of a synthetic fiber such as that known to the bow making industry under the trademark FAST FLIGHT, which is manufactured by the Brownell & Co., Inc. of Moodus, Conn., and which results in a very strong bowstring which stretches less than about two percent of its own length under tension and which is significantly more flexible than multi-wire steel cable of the sort commonly used in compound bows.

Figure 2:
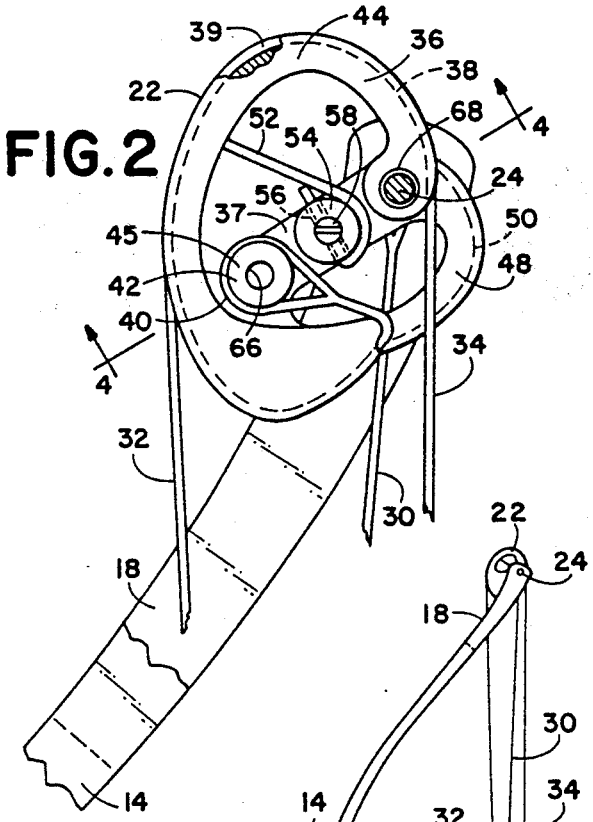
FIG. 2 is a partially cutaway left side elevational view of the tip of the upper limb, and the eccentric device of the bow shown in FIG. 1.
Figure 3:
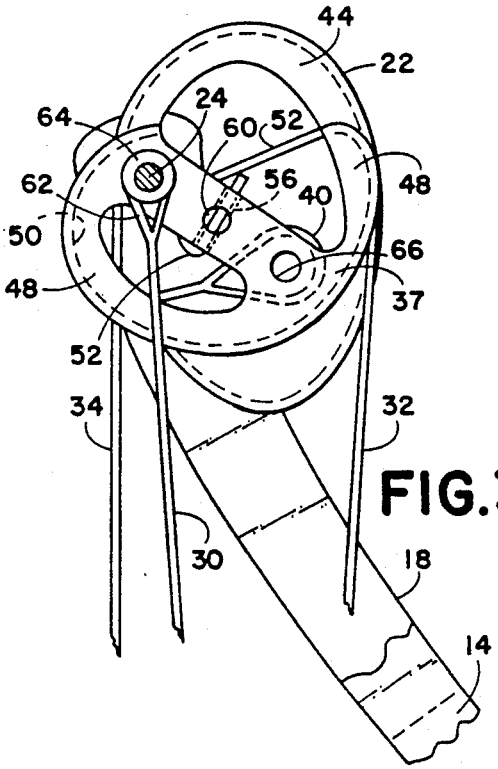
FIG. 3 is a partially cutaway right side elevational view of the tip of the upper limb and the eccentric device of the bow shown in FIG. 1.
Figure 4:
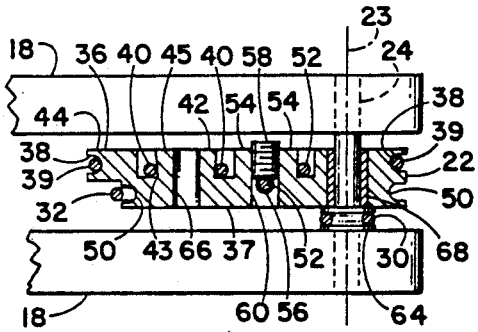
FIG. 4 is a sectional view, taken along line 4—4, of the eccentric device and a portion of the upper limb of the bow shown in FIGS. 1–3.

Referring now more particularly to FIGS. 2, 3, and 4, the eccentric device 22 is shown together with the forked tip portion 18 of the limb 14, a portion of the tip portion 18 being cut away in each of FIGS. 2 and 3 to reveal the eccentric device 22, the attachment of cables 30 and 32, respectively, to the limb 14 and the eccentric device 22 and the attachment of the bowstring 34 to the eccentric device 22.

As will be understood readily by those familiar with compound bows, the eccentric device 22 includes a bowstring side 36 whose margin defines a peripheral groove 38 which receives a bowstring leader portion 39 of the bowstring 34, extending wrapped around the eccentric device 22 when the bow 10 is in its strung, but not drawn, condition, as shown in FIGS. 1-4. As the bowstring 34 is drawn during use of the bow 10, the eccentric device 22 rotates, clockwise as shown in FIG. 2, and the leader portion 39 of the bowstring 34 unwraps from its position in the peripheral groove 38. The leader 39 of the bowstring 34 includes a loop 40, which is disposed about a post 42 which extends laterally, or axially, from a cable side 37 of the ecentric device 22. The bowstring side 36 of the eccentric device 22 is lightened by the absence of material, leaving a relatively narrow rim, and the post 42 is located within the space surrounded by the peripheral rim 44, so that the attachment of the bowstring 34 to the eccentric device 22 by the loop 40 disposed about the post 42 requires no additional space in either a lateral, axial direction or a radial direction, beyond the space defined by the size and shape required of the bow string side of the eccentric device 22 to provide the desired force and power curve for the bow 10.

In a separate plane laterally adjacent the bow string side 36 of the eccentric device 32 is the cable side portion 37, having a rim 48 similarly defining an open interior area. The margin of the cable side 37 defines a peripheral cable-receiving groove 50.

A base portion 43 of the post 42 is smaller in diameter than a head portion 45, and the post 42 is tapered from the head 45 to the base 43. Tension in the bowstring leader portion 39 therefore tends to draw the loop 40 toward the cable side 37 of the eccentric device 22 because of the tapered shape of the post 42.

The cable 32 extends from the point of its attachment to the lower limb 16 to the cable groove 50 defined in the rim 48 of the cable side 37 of the eccentric device 22. The cable 32 is wrapped around the eccentric device in the cable groove 50, from which a terminal portion 52 of the cable 32 extends to and is disposed about halfway around a post 54 which extends axially from the cable side 37 into the space defined by the rim 44 of the bowstring side 36 of the eccentric device 22. The terminal portion 52 extends further through a through-hole 56 defined in the base of the post 54, in the cable side 37, parallel with the plane defined by the cable side 37. A setscrew 58 is located in threaded engagement with a tapped bore 60 extending axially of the eccentric device 22 and located centrally in the post 54. The setscrew 58 clamps the terminal portion 52 within the through-hole 56 and thus attaches the cable 32 securely to the eccentric device 22.

As may be seen best in FIG. 3, the cable 30 includes a looped terminal portion 62 which is disposed about a suitable spacer 64, located on the pivot pin 24. A similar loop is provided in the end of the cable 32 to attach it about the pivot pin 28 mounted in the lower limb 16 (FIG. 1).

The cables 30 and 32 may be adjusted by clamping the terminal portion 52 and a similar terminal portion of the cable 32, by the use of the setscrew 58 and a corresponding setscrew in the eccentric device 26, the exact length of the cables 32 and 30 being adjusted as necessary to tune the bow in the well-known manner. The cables 30 and 32 may be of conventional multi-wire steel cable, or of a material similar to that used for the bow string 34.

The eccentric device 22 may be manufactured of a suitable metal, such as an aluminum alloy, and computer controlled metal shaping techniques may be used in its manufacture. For use in automated production, a hole 66 may be provided axially through the post 42. Preferably, a bushing 68 is provided as a bearing for rotation of the eccentric device 22 about the pivot pin 24, and appropriate spacers (not shown) are provided on either side of the eccentric device 22 to assure clearance between the eccentric device 22 and the sides of the forked tip portion 18.

Figure 5:
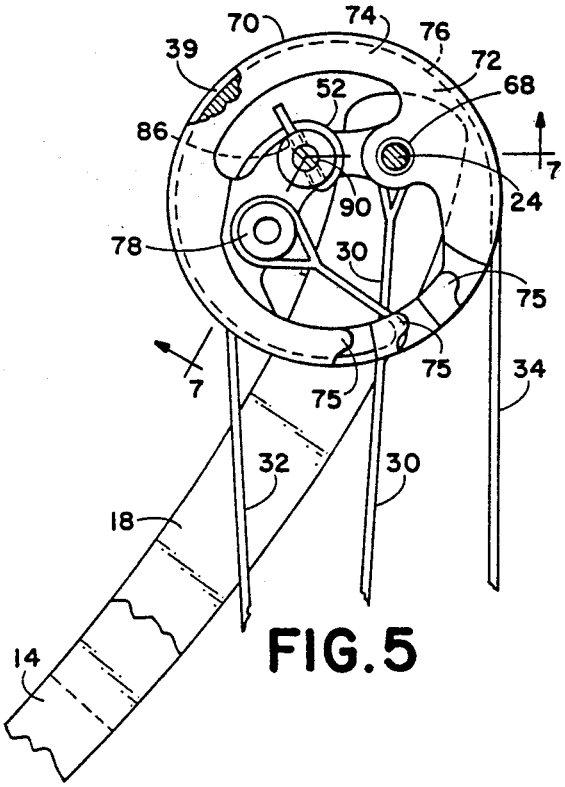
FIG. 5 is a view similar to FIG. 2, showing another embodiment of the present invention including a different eccentric device which is more circular in shape than the device shown in FIGS. 2–4.
Figure 6:
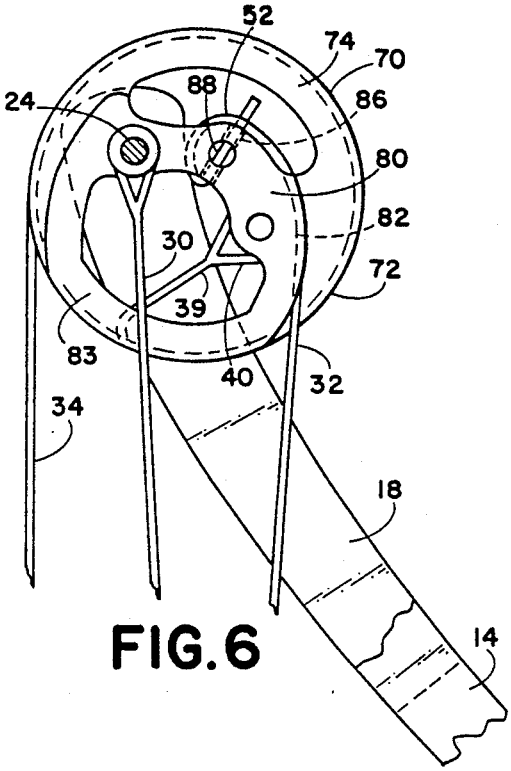
FIG. 6 is a view similar to that of FIG. 3, showing a portion of an upper limb of a compound bow equipped with the eccentric device shown in FIG. 5.
Figure 7:
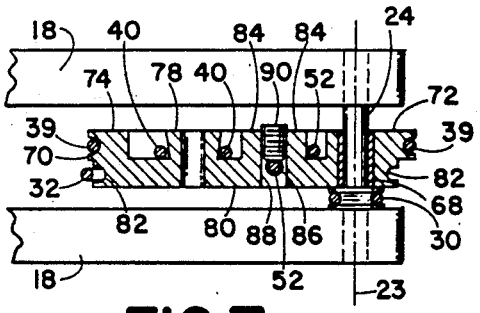
FIG. 7 is a sectional view of the eccentric device shown in FIG. 5, taken along line 7—7, together with a portion of the limb of the bow on which the device is mounted.

Referring now to FIGS. 5, 6, and 7, in an eccentric device 70, also embodying the present invention, the bow string side 72 is essentially circular and includes a rim portion 74 whose margin defines a peripheral bowstring receiving groove 76 as in the eccentric device 22. The leader portion 39 of the bowstring 34 extends around the periphery of the bow string side 72, in the groove 76, and the loop portion 40 of the bow string 34 is disposed about a post 78 which is similar to the post 42, extending axially from a cable side 80 into the space circumscribed by the rim portion 74.

As with the eccentric device 22, the cable 32 extends about the cable side 80 in a peripheral groove 82 defined by the margin of the cable side 80, which includes a rim 83 surrounding an interior space. Its terminal portion 52 extends partway around and is in contact with a post 84 extending axially away from the cable side 80 into the space circumscribed by the rim 74 of the bowstring side 72, and thence extends further through a through-hole 86 extending through a portion of the cable side 80 aligned with the base of the post 84.

As in the eccentric device 22, a threaded bore 88 and a setscrew 90 are provided, extending axially of the post 84 and aligned with the through-hole 86 so as to clamp the terminal portion 52 of the cable 32 to hold it securely attached to the eccentric device 70 at the appropriate place along the length of the cable 32.

The rim 74 is interrupted at three places defining hooks 75. The leader portion 39 of the bowstring 34 may be placed about any one of these three hooks 75 as desired to provide for adjustment of the effective length of the bowstring 34. In other respects, except for the shape of the eccentric device 70, which is relevant to the force curve of a compound bow equipped with such an eccentric device, the eccentric device 70 is similar to the eccentric cam device 22, in those respects which are related to the present invention. It will be understood, also, that the grooves 76 and 82 could be combined as a single groove around a portion of the eccentric device 70, so long as the peripheral rim is interrupted on each side at the appropriate position to lead the cable and bowstring to the respective post 78 or 84.

Figure 8:
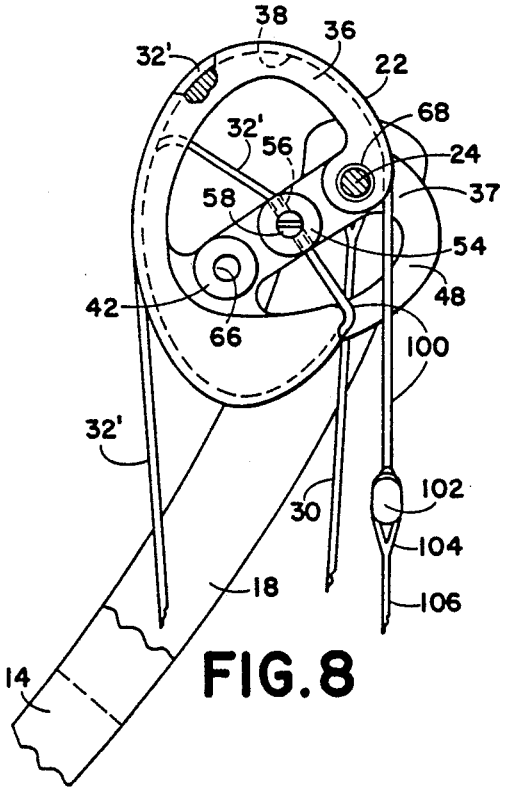
FIG. 8 is a view similar to that of FIG. 2, showing the eccentric device shown in FIGS. 2–4 equipped with a conventional cable including an extension portion to which one end of a bowstring is attached.

In FIG. 8, an eccentric cam device 22 is shown together with the forked tip portion 18 (partially cut away), of the upper limb 14, and with a conventional metal cable 32' in use, instead of the cable 32 and bowstring 34. The cable 32' extends, as did the cable 32, around the cable side 37 within the peripheral groove 38, but rather than extend around the post 54, the cable 32' extends directly through the through-hole 56. The cable 32' is held clamped at the appropriate position by the setscrew 58 in the tapped bore 60, and then extends further to the peripheral groove 38 defined in the margin of the bowstring side 36 of the eccentric device 22, as a pigtail or extension portion 100. This extension portion 100 is equipped with a bowstring-receiving hook 102 swaged onto its end. A loop 104 in the end of a bowstring 106, which is of shorter length than the bowstring 34, is secured to the hook 102 in the previously conventional manner of stringing a compound bow. Thus, it may be seen that, if desired, the eccentric device 22, and similarly the eccentric device 70, can be used in the same manner as a conventional eccentric device of the type available prior to the present invention.

In FIGS. 9, 10, and 11, a forked tip portion 18 of the upper limb 14 of the compound bow 10 is provided with an eccentric device 110 which is a third embodiment of the present invention. The shape of the eccentric device 110 is non-circular, as that of the eccentric device 22, and the leader portion 39 of the bowstring 34 extends about the eccentric device 110, and is secured to a post 111 in the same manner, which will not be discussed in detail presently. However, instead of the cable 32 of multi-wire steel cable construction, a cable 112 is provided with a terminal portion defining a loop 114 which is attached to the eccentric device 110 by being disposed about a post 116 extending axially from a base 118 locatd on the bowstring side 120. The head 122 of the post 116 is larger in diameter than the base 118, and the post 116 is tapered from the head to the base 118, so that when tension is maintained in the cable 112 the loop 114 is drawn by the tapered shape of the post 116 toward the opposite, or bowstring side 120 of the eccentric device 110, fastening the cable 112 to the eccentric device 110. A cable 124, similar to the cable 112, includes a loop 126 which is disposed about a suitable spacer 128 mounted on the pivot pin 130 in the same fashion as in the attachment of the cable 30 to the pivot pin 24, and the opposite end of the cable 112 is similarly fastened at the forked tip portion 20 of the lower limb 16 of the bow 10 (not shown).

The eccentric device 110 is particularly adapted for use of a cables 112 and 124 which are made of a flexible fiber material other than wire and which is better adapted to formation of a terminal loop such as the loop 114, for example because of greater flexibility and elasticity. The eccentric device 110 is also better adapted to cables 112 and 124 of material not well adapted to being clamped by the use of a setscrew as was provided in the eccentric devices 22 and 70 to retain the cable 32. For this reason, the cable 112 or 124 must be provided in the correct length, and adjustment of a bow equipped with the eccentric device 110 may require replacement of the cable 112 or 124 with one of a more appropriate length.

Should it be desired to use as the cable 112 or 124 a cable of wire construction, a looped end 114 of such a cable may be attached more securely to the eccentric device 110 by the use of a screw 134 including a wide flat head 136, with the post 116 being accordingly shortened, so that the head 136 of the screw 134 retains a loop of the cable 112 disposed about the post 116', as shown in FIGS. 12 and 13, without any part of the cable protruding laterally outside the space required for usual rotation of the eccentric device 110.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An eccentric device for a compound bow, comprising:

(a) first margin means for defining a cable side and a first peripheral groove extending about said cable side of said eccentric device, for receiving a portion of a cable;

(b) first fastening means located radially inward of said eccentric device from a portion of said first peripheral groove, for fastening a portion of said cable to said eccentric device;

(c) second margin means for defining a bowstring side and a second peripheral groove extending about said bowstring side of said eccentric device in a location laterally spaced apart from said first peripheral groove, for receiving a portion of a flexible tension-bearing bowstring leader; and (d) second fastening means located radially inward of said eccentric device from a portion of said second peripheral groove, for fastening a terminal portion of said bowstring leader to said eccentric device, wherein said first fastening means includes a first post on said bowstring side of said eccentric device, said first post defining a threaded bore, and said first fastening means further including means defining a through-hole in said eccentric device for receiving said portion of said cable, and setscrew means adjustably disposed in said threaded bore for clamping said portion of said cable within said through-hole.

2. An eccentric device for a compound bow, comprising:

(a) fist margin means for defining a cable side and a first peripheral groove extending about said cable side of said eccentric device, for receiving a portion of a cable;

(b) first fastening means located radially inward of said eccentric device from a portion of said first peripheral groove, for fastening a portion of said cable to said eccentric device;

(c) second margin means for defining a bowstring side and a second peripheral groove extending about said bowstring side of said eccentric device in a location laterally spaced apart from said first peripheral groove, for receiving a portion of a flexible tension-bearing bowstring leader; and (d) second fastening means located radially inward of said eccentric device from a portion of said second peripheral groove, for fastening a terminal portion of said bowstring leader to said eccentric device, wherein said first fastening means includes a first post on said bowstring side of said eccentric device, said first post having a base and a top, said eccentric device generally defining a plane, and said top of said first post being larger than its base and said first post being tapered between said top and said base, so that tension in said bowstring leader against said first post in a direction generally in said plane of said eccentric device will urge said bowstring leader toward said base of said post.

3. An eccentric device for a compound bow, comprising:

(a) first margin means, defining a cable side and a first peripheral groove extending about said cable side of said eccentric device, for receiving a portion of a cable;

(b) first fastening means located radially inward of said eccentric device from a portion of said first peripheral groove, for fastening a portion of said cable to said eccentric device;

(c) second margin means, defining a bowstring side and a second peripheral groove extending about said bowstring side of said eccentric device in a location laterally spaced apart from said first peripheral groove, for receiving a portion of a flexible tension-bearing bowstring leader; and (d) second fastening means located radially inward of said eccentric device from a portion of said second peripheral groove, for fastening a terminal portion of said bowstring leader to said eccentric device, wherein said eccentric device has an axis of rotation defining an axial direction, and at least one of said first and second fastening means includes a post extending axially of said eccentric device, said post being located within a space at least partly circumscribed by respective parts of one of said first and second margin means, further wherein said at least one post defines a threaded bore and has a screw threadably engaged therein, said screw having a wide head protruding radially beyond said post so as to retain a looped portion of said bowstring leader attached to said post.

4. Apparatus for drawing the limbs of a compound bow, comprising:

(a) a pair of eccentric devices, each defining a respective axis of rotation and each having:

(i) first margin means, defining a cable side and a first peripheral groove extending about said cable side of said eccentric device, for receiving a portion of a cable;

(ii) first fastening means located radially inward of said eccentric device from a portion of said first peripheral groove, for fastening a portion of said cable to said eccentric device;

(iii) second margin means, defining a bowstring side and a second peripheral groove extending about said bowstring side of said eccentric wheel in a location laterally spaced apart from said first peripheral groove, for receiving a portion of a flexible tension-bearing bowstring leader; and (iv) second fastening means located radially inward of said eccentric device from a portion of said second peripheral groove, for fastening a terminal portion of said bowstring leader to said eccentric device, said first fastening means including a first post on said bowstring side of said eccentric device, said first post defining a threaded bore, and said first fastening means further including means defining a through-hole in said eccentric device for receiving said portion of said cable, and setscrew means adjustably disposed in said threaded bore for clamping said portion of said cable within said through-hole;

(b) a bowstring including a pair of bowstring leaders located at respective opposite ends thereof, each of said bowstring leaders having a terminal portion attached to a respective one of said eccentric devices by the respective one of said second fastening means; and (c) a pair of cable each having a portion thereof attached to a respective one of said eccentric devices by the respective one of said first fastening means.

5. Apparatus for drawing the limbs of a compound bow, comprising:

(a) a pair of eccentric devices, each defining a respective axis of rotation and each having:

(i) first margin means, defining a cable side and a first peripheral groove extending about said cable side of said eccentric device, for receiving a portion of a cable;

(ii) first fastening means located radially inward of said eccentric device from a portion of said first peripheral groove, for fastening a portion of said cable to said eccentric device;

(iii) second margin means, defining a bowstring side and a second peripheral groove extending about said bowstring side of said ecentric device in a location laterally spaced apart from said first peripheral groove, for receiving a portion of a flexible tension-bearing bowstring leader; and (iv) second fastening means located radially inward of said eccentric device from a portion of said second peripheral groove, for fastening a terminal portion of said bowstring leader to said eccentric device, the respective axis of rotation defining an axial direction in said eccentric device, at least one of said first and second fastening means of said eccentric device including a post located eccentrically with respect to said axis of rotation and extending axially of the respective eccentric device, said post being located on each side eccentric device within a space at least partly circumscribed by the respective one of said first and second margin means thereof, (b) a bowstring including a pair of bowstring leaders located at respective opposite ends thereof, each of said bowstring leaders having a terminal portion attached to a respective one of said second fastening means; and (c) a pair of cables each having a portion thereof attached to a respective one of said eccentric devices by the respective one of said first fastening means, wherein said post of each said eccentric device has a base and a top, each said eccentric device generally defining a plane, and said top of said post being larger than its base and said post being tapered between said top and said base, so that tension pulling a portion of a respective one of said cable and said bowstring leader against said post in a direction generally in said plane of said eccentric device urges the respective one of said cable and said bowstring leader toward said base of said post.

6. A compound bow, comprising:

(a) a riser;

(b) a pair of oppositely extending limbs attached to said riser;

(c) an eccentric device rotatably attached to each of said limbs, each said eccentric device having a bowstring side and a cable side and including:

(i) first margin means, defining a first peripheral groove extending about said cable side of said eccentric device, for receiving a portion of a cable;

(ii) first fastening means located radially inward of said eccentric device from a portion of said first peripheral groove, for fastening a portion of said cable to said eccentric device;

(iii) second margin means, defining a bowstring side and a second peripheral groove extending about said bowstring side of said eccentric wheel in a location laterally spaced apart from said first peripheral groove, for receiving a portion of a flexible tension-bearing bowstring leader; and (iv) second fastening means located radially inward of said eccentric device from a portion of said second peripheral groove, for fastening a terminal portion of said bowstring leader to said eccentric device, said first fastening means including a first post on said bowstring side of said eccentric device, said first post defining a threaded bore, and said first fastening means further including means defining a through-hole in said eccentric device for receiving said portion of the respective cable, and setscrew means adjustably disposed in said threaded bore for clamping said portion of said cable within said through-hole;

(d) a bowstring including a pair of bowstring leaders located at respective opposite ends thereof, each of said bowstring leaders having a terminal portion attached to a respective one of said eccentric devices by the respective one of said second fastening means; and (e) a pair of cable each having a portion thereof attached to a respective one of said eccentric devices by the respective one of said first fastening means.

7. A compound bow, comprising:

(a) a riser;

(b) a pair of oppositely extending limbs attached to said riser;

(c) an eccentric device rotatably attached to each of said limbs, each said eccentric device including:

(i) first margin means, defining a cable side and a first peripheral groove extending about said cable side of said eccentric device, for receiving a portion of a cable;

(ii) first fastening means located radially inward of said eccentric device from a portion of said first peripheral groove, for fastening a portion of said cable to said eccentric device;

(iii) second margin means, defining a bowstring side and a second peripheral groove extending about said bowstring side of said eccentric wheel in a location laterally spaced apart from said first peripheral groove, for receiving a portion of a flexible tension-bearing bowstring leader; and (iv) second fastening means located radially inward of said eccentric device from a portion of said second peripheral groove, for fastening a terminal portion of said bowstring leader to said eccentric device, each said eccentric device having an axis of rotation defining an axial direction, and at least one of said first and second fastening means of each of said eccentric devices including a post extending axially of the respective eccentric device, said post being located within a space at least partly circumscribed by respective parts of said first and second margin means of the respective eccentric device;

(d) a bowstring including a pair of bowstring leaders at respective opposite ends thereof, each of said bowstring leaders having a terminal portion attached to a respective one of said eccentric devices by the respective one of said second fastening means; and (e) a pair of cables each having a portion thereof attached to a respective one of said eccentric devices by the respective one of said first fastening means, wherein each said post of each said eccentric device has a base and a top, each said eccentric device generally defining a plane, and said top of said post being larger than its base and said post being tapered between said top and said base, so that tension pulling a portion of a respective one of said cable and said bowstring leader against said post in a direction generally in said plane of said eccentric device urges the respective one of said cable and said bowstring leader toward said base of said post.

8. The compound bow of claim 7 wherein said bowstring and each of said cables are of a non-metallic synthetic fiber material, each said cable and each of said bowstring leaders including a looped terminal portion disposed about a respective one of said first and second fastening means.

9. A rotary eccentric device for a compound bow, comprising:

(a) peripheral marginal groove means extending about said eccentric device, for receiving a portion of a cable and a portion of a flexible tension-bearing bowstring leader;

(b) means for defining an axis of rotation of said eccentric device;

(c) first fastening means, located eccentrically with respect to said eccentric device form a portion of said peripheral marginal groove means, for fastening a terminal portion of said cable to said eccentric device; and (d) second fastening means, including an axially extending post located eccentrically of said axis of rotation and radially inward of said eccentric device from a portion of said peripheral marginal groove means, for fastening a terminal loop portion of said bowstring leader to said marginal groove means, for fastening a terminal loop portion of said bowstring leader to said eccentric device, wherein said post includes a bore and a screw threadably engaged therein, said screw having a wide head protruding radially beyond said post so as to retain said terminal loop portion of said bowstring attached to said post.

* * * * *